US011504564B2

(12) United States Patent
Hsu

(10) Patent No.: US 11,504,564 B2
(45) Date of Patent: Nov. 22, 2022

(54) EXERCISE MACHINE AND RESISTANCE AND BRAKE COMPOUND CONTROL STRUCTURE THEREOF

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 17/307,434

(22) Filed: May 4, 2021

(65) Prior Publication Data

US 2021/0370124 A1 Dec. 2, 2021

(30) Foreign Application Priority Data

May 29, 2020 (TW) ..... 109206718

(51) Int. Cl.
*A63B 21/00* (2006.01)
*A63B 21/015* (2006.01)
(Continued)

(52) U.S. Cl.
CPC ..... *A63B 21/00069* (2013.01); *A63B 21/015* (2013.01); *A63B 21/225* (2013.01); *A63B 22/0605* (2013.01)

(58) Field of Classification Search
CPC ..... A63B 21/015; A63B 21/00069; A63B 22/0605; A63B 71/0054; A63B 21/0051; A63B 21/008; A63B 2225/68; A63B 2071/0081; A63B 2220/13; A63B 22/0056; A63B 2071/0694; A63B 2220/00; A63B 21/0085; A63B 22/0664; A63B 2225/093; A63B 2230/75; A63B 2071/065;
(Continued)

(56) References Cited

U.S. PATENT DOCUMENTS 6,612,970 B2 * 9/2003 Forcillo ..... A63B 21/4049 482/57
6,669,603 B1 * 12/2003 Forcillo ..... A63B 21/015 D21/667
(Continued)

OTHER PUBLICATIONS https://www.rpk.es/en/product-details/assembly-for-valvetronic-bmv-torsion-spring-flat-spring/ (Year: 2016).*

*Primary Examiner* — Andrew S Lo
*Assistant Examiner* — Andrew M Kobylarz
(74) *Attorney, Agent, or Firm* — Rosenberg, Klein & Lee

(57) ABSTRACT

An exercise machine and a resistance and brake compound control structure are disclosed. The resistance and brake compound control structure includes a sleeve, a push rod, an elastic member, a compound operating member, and a pushing member. The push rod is disposed in the sleeve. The elastic member exerts a force to the push rod for giving the push rod a return elastic force. The compound operating member includes an operating portion and a screw rod. The screw rod has a pushing end extending into the sleeve. The pushing member is disposed in the sleeve in a non-rotatable manner. The pushing member has a threaded hole. The screw rod is screwed to the threaded hole. The exercise machine uses the resistance and brake compound control structure to adjust resistance and brake.

11 Claims, 10 Drawing Sheets

(51) Int. Cl.
*A63B 21/22* (2006.01)
*A63B 22/06* (2006.01)

(58) Field of Classification Search
CPC ..... A63B 2220/20; A63B 2220/34; A63B 2220/58; A63B 21/225; B62L 1/005
See application file for complete search history.

(56) References Cited

U.S. PATENT DOCUMENTS

| | | | | |
|---|---|---|---|---|
| D682,371 | S * | 5/2013 | Baudhuin | D21/667 |
| 10,688,344 | B2 * | 6/2020 | Wu | A63B 21/015 |
| 2016/0310785 | A1 * | 10/2016 | Lo | A63B 21/015 |
| 2017/0036053 | A1 * | 2/2017 | Smith | A63B 21/015 |
| 2017/0056700 | A1 * | 3/2017 | Wu | A63B 21/015 |

* cited by examiner

EXERCISE MACHINE AND RESISTANCE AND BRAKE COMPOUND CONTROL STRUCTURE THEREOF

FIELD OF THE INVENTION

The present invention relates to an exercise machine and a resistance and brake compound control structure. The friction force of the resistance unit of the exercise machine is controlled by rotating or pressing operations, so that the flywheel can gradually adjust the resistance or quickly brake.

BACKGROUND OF THE INVENTION

Taiwan Patent Publication No. 1669141 discloses a spinning bike with an integrated brake and resistance adjustment mechanism, comprising a frame, a transmission wheel, a flywheel, and a resistance brake device. The transmission wheel is arranged on the frame. The flywheel may be made of a metal material and is driven to rotate by the transmission wheel. The resistance brake device includes a magnet assembly, a resistance adjustment seat, a control member, a manual brake assembly, and a resistance control assembly. The resistance adjustment seat is connected to the frame. The magnet assembly is pivotally connected to the resistance adjustment seat. The control member is connected to the magnet assembly. The manual brake assembly is installed on the handlebar of the frame, and includes a brake handle and a brake control line. The resistance control assembly includes a motor, a control interface, and a resistance control winding.

In the above-mentioned patent, the brake of the flywheel is controlled by the manual brake assembly, and the resistance change of the flywheel is controlled by the resistance control assembly. The brake handle of the manual brake assembly operates the magnet assembly through the brake control line in a mechanical mode to obtain the braking effect. The resistance control assembly adjusts the magnitude of the resistance through the control interface in an electric mode. The above-mentioned structure uses the "mechanical mode" combined with the "electric mode" to complete the braking and to adjust the magnitude of resistance. The "electric mode" needs to rely on the touch control panel solely for performing. Obviously, it is not fully integrated with the brake handle in structure. Therefore, when the user performs the "braking" and "resistance adjustment" operations, the operating positions are separate. When the user performs the "braking" operation, it is controlled by the brake handle; when the user performs the "resistance adjustment" operation, it is controlled by the touch control panel. The operational integration is obviously not better.

SUMMARY OF THE INVENTION

According to one aspect of the present invention, a resistance and brake compound control structure is provided. The resistance and brake compound control structure comprises a sleeve, a push rod, an elastic member, a compound operating member, and a pushing member. The sleeve includes an operating end and an acting end. The push rod is disposed in the sleeve. The push rod is movable to extend out of the acting end. The elastic member is disposed in the sleeve. The elastic member is configured to exert a force to the push rod for giving the push rod a return elastic force toward the operating end. The compound operating member includes an operating portion and a screw rod. The compound operating member is disposed at the operating end. The screw rod extends into the sleeve. The screw rod has a pushing end. The pushing member is disposed in the sleeve in a non-rotatable manner. The pushing member has a threaded hole. The screw rod is screwed to the threaded hole. When the operating portion is rotated, the pushing member stays in the sleeve through the return elastic force, the screw rod is rotated relative to the pushing member, and the pushing end is rotated to push the push rod. When the operating portion is pushed, the screw rod and the pushing member are pushed synchronously to push the push rod.

Preferably, a clamping member is fixed in the sleeve to block a rotation path of the pushing member so that the pushing member cannot be rotated.

Preferably, the sleeve has a circular hole. The clamping member has another threaded hole. A fixing member is inserted through the circular hole and threadedly connected to the clamping member for fixing the clamping member in the sleeve.

Preferably, an inner edge of the sleeve has a non-circular cross-sectional profile. A cross-sectional profile of the pushing member corresponds in shape to the cross-sectional profile of the inner edge of the sleeve.

Preferably, the resistance and brake compound control structure further comprises a resistance unit and a flywheel. The resistance unit and the flywheel are mounted to an exercise machine. The pushing member drives the resistance unit for controlling the resistance unit to gradually contact or move away from the flywheel.

Preferably, one end of the push rod, facing the operating end, has a flange. The acting end of the sleeve is threadedly connected to a nut. The nut has a perforation. The push rod passes through the perforation and extends out of the acting end. The elastic member is a spring. The spring is sleeved on the push rod. Two ends of the spring abut against the flange and the nut, respectively.

According to another aspect of the present invention, an exercise machine is provided. The exercise machine comprises an exercise machine body, a resistance unit, a flywheel, and a resistance and brake compound control structure. The resistance unit is movably mounted to the exercise machine body. The flywheel is rotatably mounted to the exercise machine body. The resistance and brake compound control structure comprises a sleeve, a push rod, an elastic member, a compound operating member, and a pushing member. The sleeve includes an operating end and an acting end. The push rod is disposed in the sleeve. The push rod is movable to extend out of the acting end. The elastic member is disposed in the sleeve. The elastic member is configured to exert a force to the push rod for giving the push rod a return elastic force toward the operating end. The compound operating member includes an operating portion and a screw rod. The compound operating member is disposed at the operating end. The screw rod extends into the sleeve. The screw rod has a pushing end. The pushing member is disposed in the sleeve in a non-rotatable manner. The pushing member has a threaded hole. The screw rod is screwed to the threaded hole. When the operating portion is rotated, the pushing member stays in the sleeve through the return elastic force, the screw rod is rotated relative to the pushing member, the pushing end is rotated to push the push rod, and the push rod abuts against the resistance unit so that the resistance unit generates a rotation resistance to the flywheel. When the operating portion is pushed, the screw rod and the pushing member are pushed synchronously to push the push rod, and the push rod abuts against the resistance unit so that the resistance unit generates a braking resistance to the flywheel.

Preferably, a clamping member is fixed in the sleeve to block a rotation path of the pushing member so that the pushing member cannot be rotated.

Preferably, the sleeve has a circular hole. The clamping member has another threaded hole. A fixing member is inserted through the circular hole and threadedly connected to the clamping member for fixing the clamping member in the sleeve.

Preferably an inner edge of the sleeve has a non-circular cross-sectional profile. A cross-sectional profile of the pushing member corresponds in shape to the cross-sectional profile of the inner edge of the sleeve.

Preferably, one end of the push rod, facing the operating end, has a flange. The acting end of the sleeve is threadedly connected to a nut. The nut has a perforation. The push rod passes through the perforation and extends out of the acting end. The elastic member is a spring. The spring is sleeved on the push rod. Two ends of the spring abut against the flange and the nut, respectively.

Preferably, the resistance unit has an elastic plate, a pivot member, a seat, and a friction plate. The elastic plate has a fixed end and a free end. The fixed end is fixed to the exercise machine body. The pivot member is fixed to the free end. The seat is pivotally connected to the pivot member. The friction plate is secured to the seat. The push rod pushes against the fixing member or the elastic plate for the friction plate to contact the flywheel. The elastic plate gives the seat a return force toward the sleeve.

Preferably, the pivot member has a notch. The push rod passes through the notch and abuts against the elastic plate.

According to the above technical features, the following effects can be achieved:

1. The pushing member of the present invention can be moved axially in the sleeve but cannot be rotated in the sleeve. By rotating the compound operating member, the push rod can be driven to move slowly in the axial direction, so that the resistance unit can adjust the resistance to the flywheel. By pressing the compound operating member, the push rod can be driven to move quickly in the axial direction, so that the resistance unit quickly brakes the flywheel.

2. The present invention integrates the structure of adjusting resistance and fast braking into a compound control structure, which makes the operation more intuitive and convenient. Adjusting resistance and fast braking can be accomplished by the compound operating member.

DESCRIPTION OF THE PREFERRED EMBODIMENTS

Embodiments of the present invention will now be described, by way of example only, with reference to the accompanying drawings.

Figure 1:
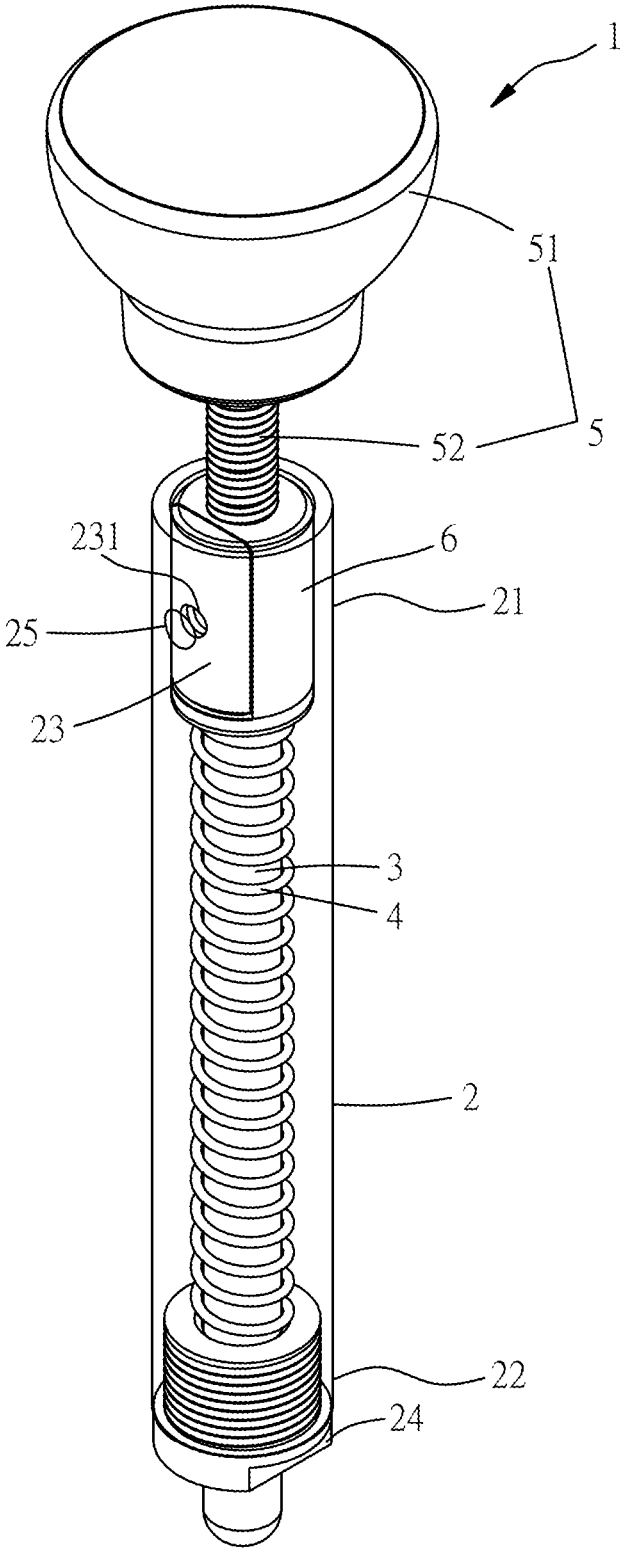
FIG. 1 is a perspective view of the resistance and brake compound control structure of the present invention.
Figure 2:
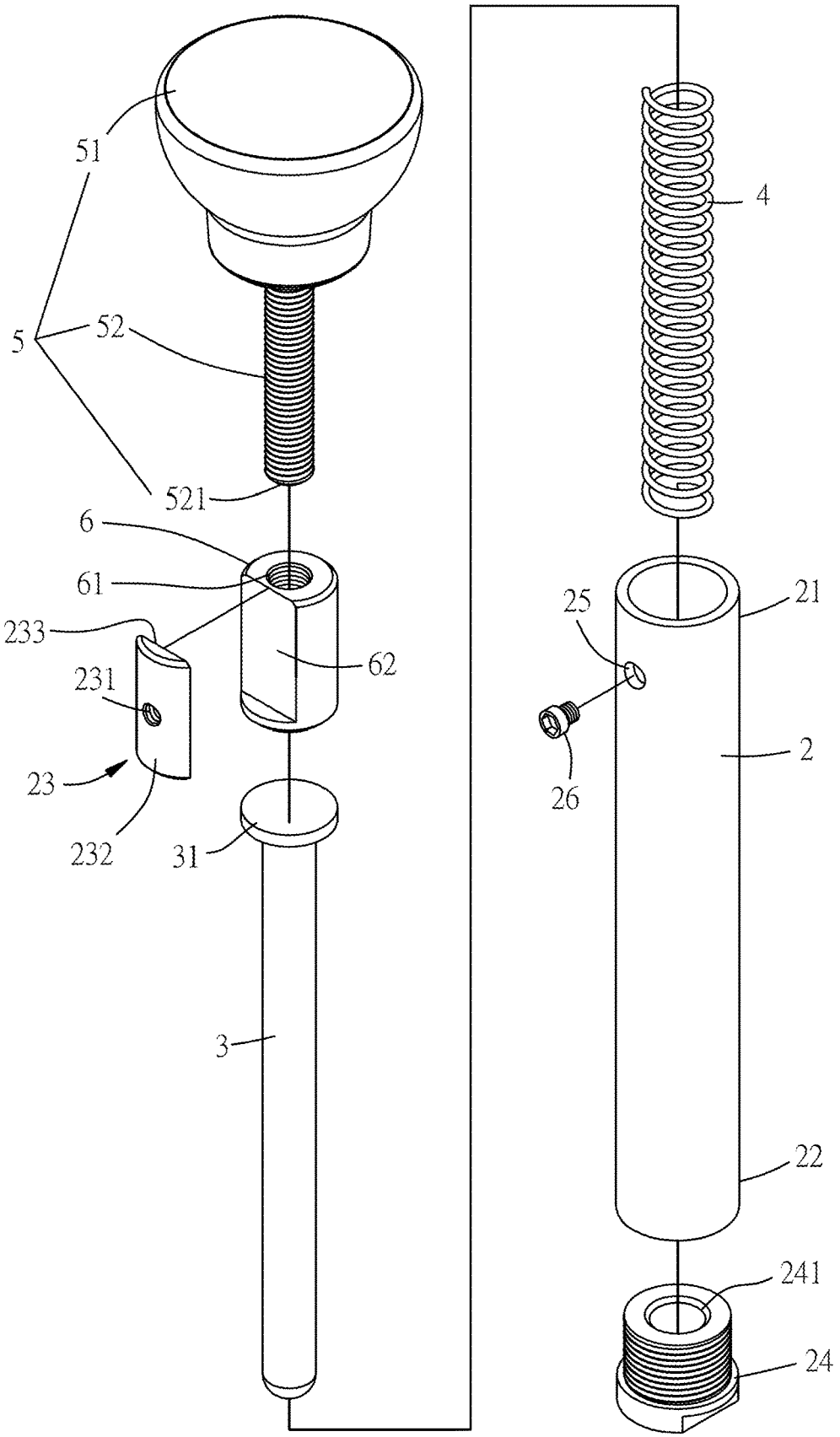
FIG. 2 is an exploded view of the resistance and brake compound control structure of the present invention.

As shown in FIG. 1 and FIG. 2, the present invention discloses a resistance and brake compound control structure 1. The resistance and brake compound control structure 1 comprises a sleeve 2, a push rod 3, an elastic member 4, a compound operating member 5, and a pushing member 6. The sleeve 2 includes an operating end 21, an acting end 22, a clamping member 23, a nut 24, a circular hole 25, and a fixing member 26. In this embodiment, the fixing member 26 is a screw. The clamping member 23 is inserted into the sleeve 2. The clamping member 23 has a first threaded hole 231. The first threaded hole 231 corresponds to the circular hole 25. The fixing member 26 is inserted through the circular hole 25 and screwed to the first threaded hole 231 for fixing the clamping member 23 to the operating end 21 of the sleeve 2. The clamping member 23 has a curved surface 232 and a flat surface 233. The curved surface 232 is in close contact with the inner wall of the sleeve 2. The flat surface 233 faces the axis of the sleeve 2. The pushing member 6 is inserted into the operating end 21 of the sleeve 2. The pushing member 6 has a second threaded hole 61. The pushing member 6 is generally cylindrical. The circumference of the pushing member 6 is formed with a stop surface 62. The flat surface 233 of the clamping member 23 abuts against the stop surface 62 to restrict the pushing member 6 from rotating in the sleeve 2. The compound operating member 5 includes an operating portion 51 and a screw rod 52. The screw rod 52 extends from the operating portion 51. The screw rod 52 has a pushing end 521 at one end thereof. The compound operating member 5 is disposed at the operating end 21. The screw rod 52 extends into the sleeve 2 and is screwed to the second threaded hole 61. The push rod 3 is placed in the sleeve 2. One end of the push rod 3, facing the operating end 21, has a flange 31. The flange 31 abuts against the pushing member 6. The other end of the push rod 3 extends out of the acting end 22. The elastic member 4 is disposed in the sleeve 2. One end of the elastic member 4 abuts against the flange 31 of the push rod 3. The nut 24 is locked to the acting end 22 of the sleeve 2, so that the other end of the elastic member 4 abuts against the nut 24. The nut 24 has a perforation 241 for the push rod 3 to pass through the perforation 241 and extend out of the acting end 22. When the push rod 3 exerts a force to the elastic element 4, the elastic element 4 will give the push rod 3 a return elastic force toward the operating end 21.

Figure 3:
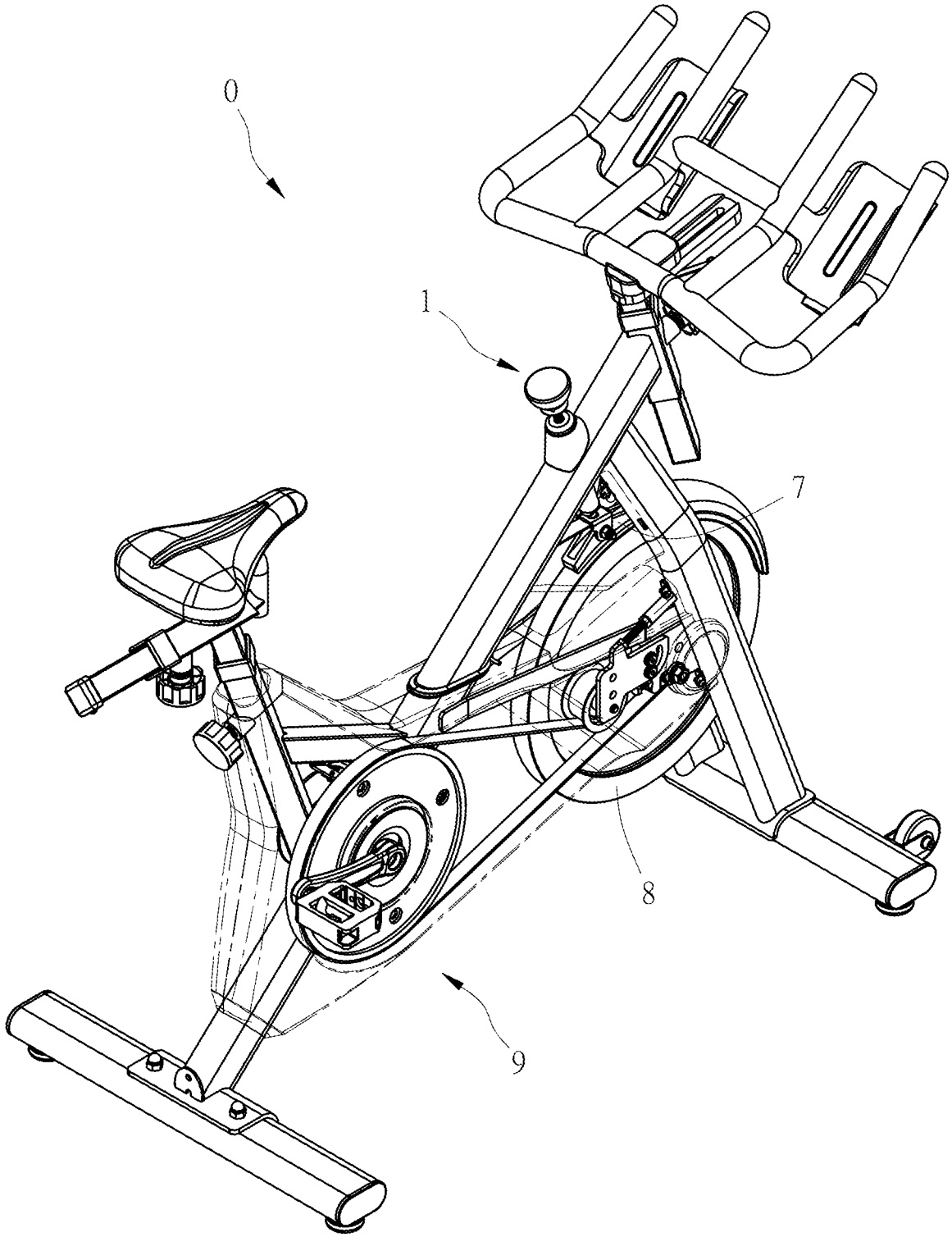
FIG. 3 is a perspective view of the exercise machine having the resistance and brake compound control structure of the present invention.
Figure 4:
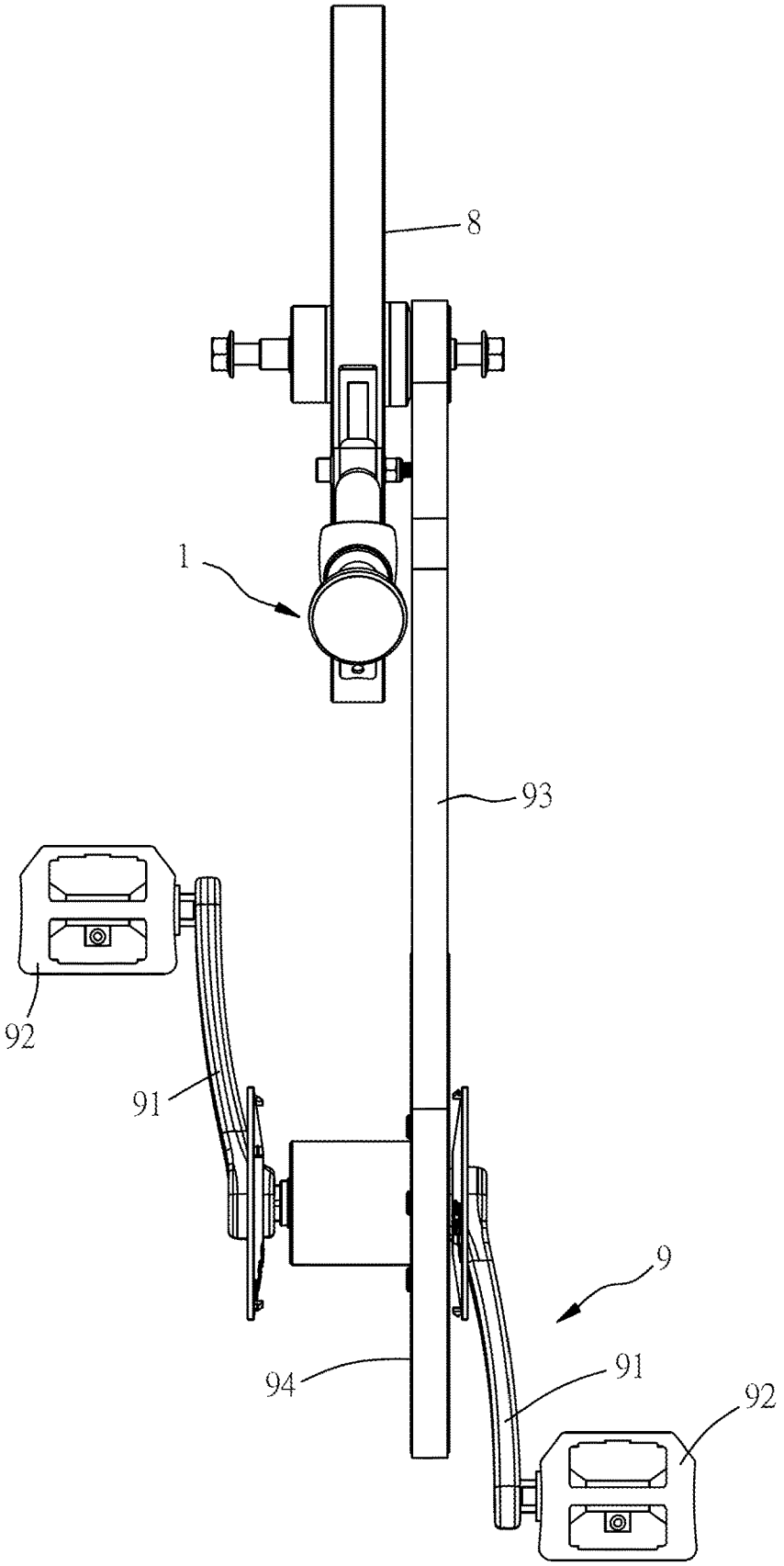
FIG. 4 is a schematic view showing the connection relationship between the exercise machine and the resistance and brake compound control structure of the present invention.
Figure 5:
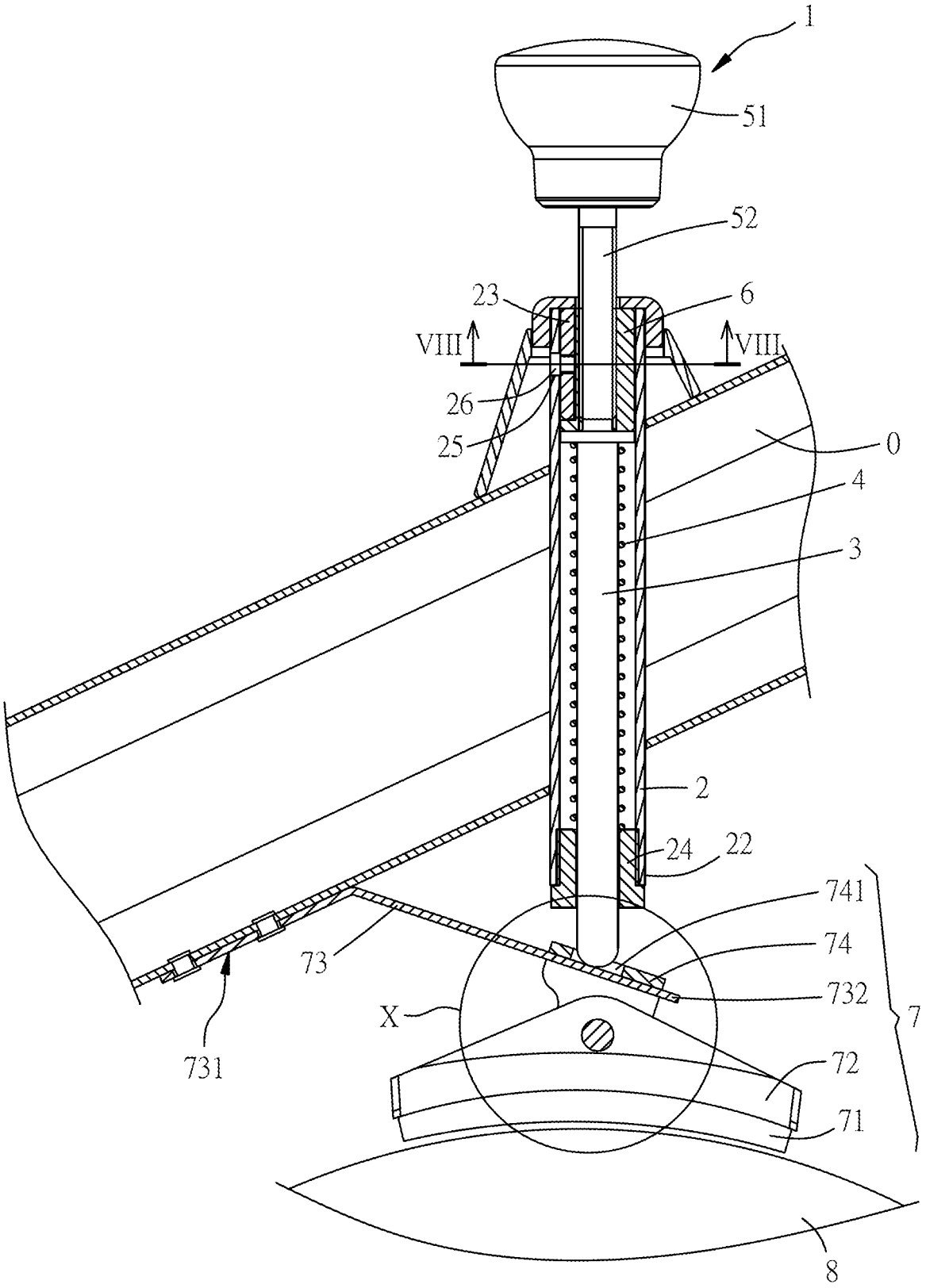
FIG. 5 is a cross-sectional view of the resistance and brake compound control structure of the exercise machine of the present invention.

Referring to FIGS. 3 to 5, an exercise machine of this embodiment includes the resistance and brake compound control structure 1 installed on an exercise machine body 0. The exercise machine in this embodiment is an exercise bike as an example. The exercise machine includes a resistance unit 7, a flywheel 8, and a stepping part 9. The resistance unit 7 has a friction plate 71, a seat 72, an elastic plate 73, and a pivot member 74. The friction plate 71 is connected to the seat 72. The friction plate 71 is made of wool felt. The seat 72 is pivotally connected to the pivot member 74. The elastic plate 73 has a fixed end 731 and a free end 732. The fixed end 732 is fixed to the exercise machine body 0. The pivot member 74 is fixed to the free end 732. The elastic plate 73 is located between the pivot member 74 and the acting end 22 of the sleeve 2. Please refer to FIG. 10. The pivot member 74 has a notch 741. The notch 741 has a first stop portion 742 and a second stop portion 743. A distance D is defined from the first stop portion 742 to the second stop portion 743. The push rod 3 corresponds in position to the notch 741 and abuts against the elastic plate 74. The push rod 3 is movable in the distance D. The notch 741 is configured to prevent the push rod 3 from slipping in operation. By pushing the push rod 3 against the pivot member 74, the friction plate 71 is driven to be in contact with the flywheel 8. Referring to FIGS. 3 to 5, the stepping part 9 is disposed on the exercise machine body 0. The stepping part 9 has a crank 91, a pedal 92, a belt 93, and a pulley 94. The pulley 94 is connected to the crank 91. The crank 91 is connected to the pedal 92. The belt 93 is connected to the pulley 94. The belt 93 transmits power to the flywheel 8.

Figure 6:
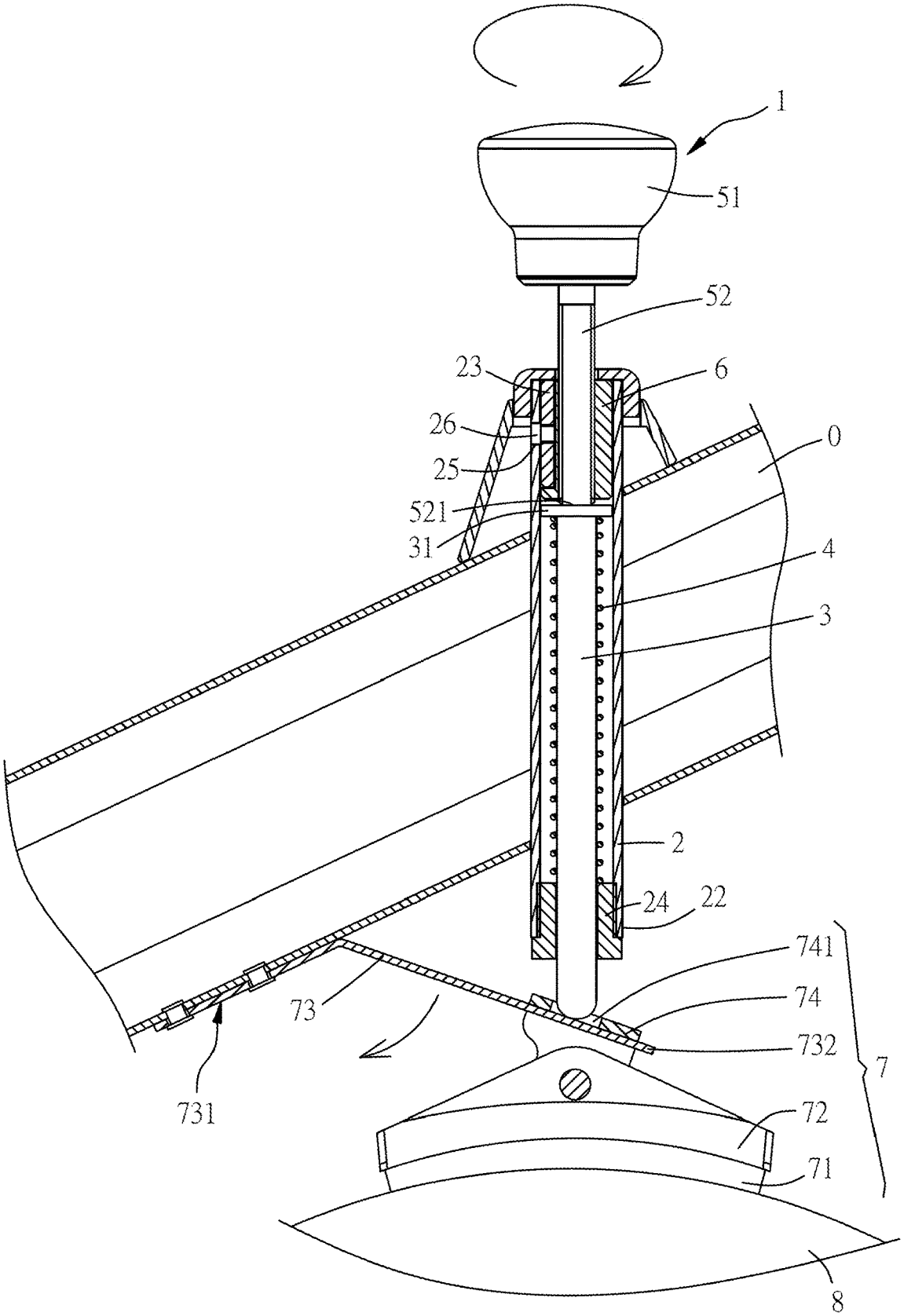
FIG. 6 is a schematic view showing the operation of the resistance adjustment of the resistance and brake compound control structure of the present invention.

As shown in FIGS. 4-6, when the user exercises on the exercise machine body 0 by stepping the pedal 92, the pedal 92 enables the crank 91 to drive the pulley 94 to rotate. The pulley 94 rotates the flywheel 8 via the belt 93. When the friction plate 71 is in contact with the flywheel 8, by controlling the friction plate 71 to approach or move away from the flywheel 8, the resistance to rotation of the flywheel 8 can be changed, thereby adjusting the intensity of exercise. In this embodiment, when the operating portion 51 is rotated clockwise, the screw rod 52 will rotate relative to the pushing member 6. Because the pushing member 6 is restricted by the clamping member 23 and cannot rotate in the sleeve 2, the pushing member 6 will move slightly along the axial direction of the sleeve 2 in a spiral manner. The pushing end 521 screwed out of the pushing member 6 presses the push rod 3 downward. The flange 31 of the push rod 3 presses one end of the elastic member 4 downward. The other end of the elastic member 4 is blocked by the nut 24. The push rod 3 extends out of the nut 24 to press the elastic plate 73 downward, so that the pivot member 74, the seat 72 and the friction plate 71 are moved toward the flywheel 8. Through the friction plate 71 to be in contact with the flywheel 8, the flywheel 8 generates a rotation resistance, and the rotation resistance provides the resistance required by the user to exercise. In the above operation, when the operating portion 51 is rotated clockwise, the closer the friction plate 71 is against the flywheel 8, the greater the rotation resistance of the flywheel 8 will be; when the operating portion 51 is rotated counterclockwise, the looser the friction plate 71 is against the flywheel 8, the less the rotation resistance of the flywheel 8 will be.

Figure 7:
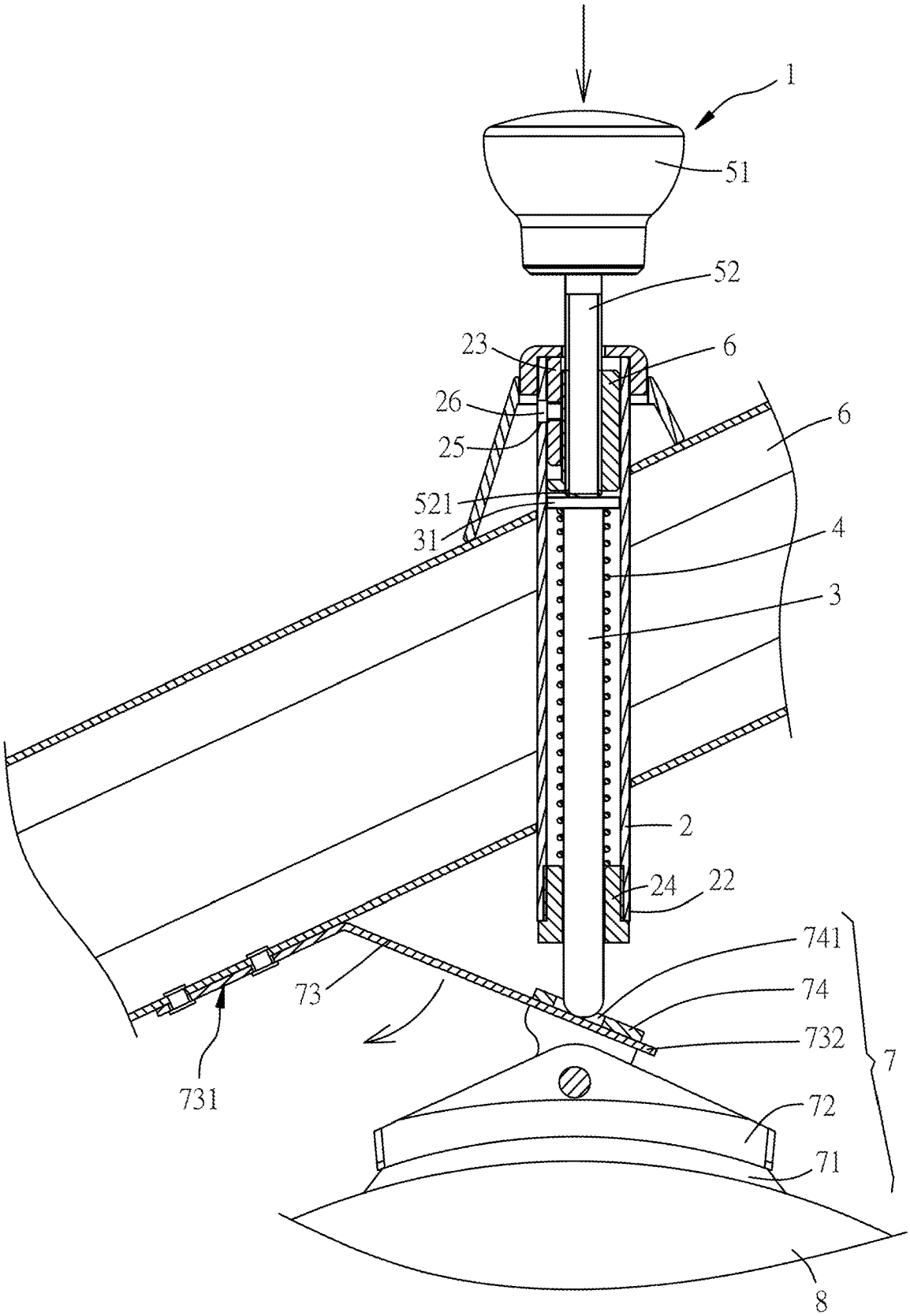
FIG. 7 is a schematic view showing the operation of the braking of the resistance and brake compound control structure of the present invention.

Please refer to FIG. 7. When the user wants to stop exercising, the operating portion 51 is directly pressed. The screw rod 52 drives the pushing member 6 to move down synchronously and quickly along the axial direction of the sleeve 2 and directly drives the push rod 3 to move linearly. One end of the elastic member 4 is pressed down by the flange 31, and the other end of the elastic member 4 is blocked by the nut 24. The push rod 3 extends out of the nut 24 and presses the elastic plate 73 down, so that the pivot member 74, the seat 72 and the friction plate 71 are moved quickly toward the flywheel 8. When the friction plate 71 is in contact with the flywheel 8, a braking resistance will be generated on the flywheel 8. The braking resistance is sufficient to make the flywheel 8 quickly reduce the speed or even stop rotating, so that there is no need for the user to spend time waiting for the flywheel 8 to stop rotating. After the brake is completed, the operating portion 51 is released. The spring 4 pushes the push rod 3 away from the flywheel 8, and the push rod 3 pushes the pushing member 6 and the compound operating member 5 back to the position before operation. When the push rod 3 is moved away from the flywheel 8, the elastic force of the elastic plate 73 enables the pivot member 74, the seat 72 and the friction plate 71 to be moved away from the flywheel 8.

Figure 8:
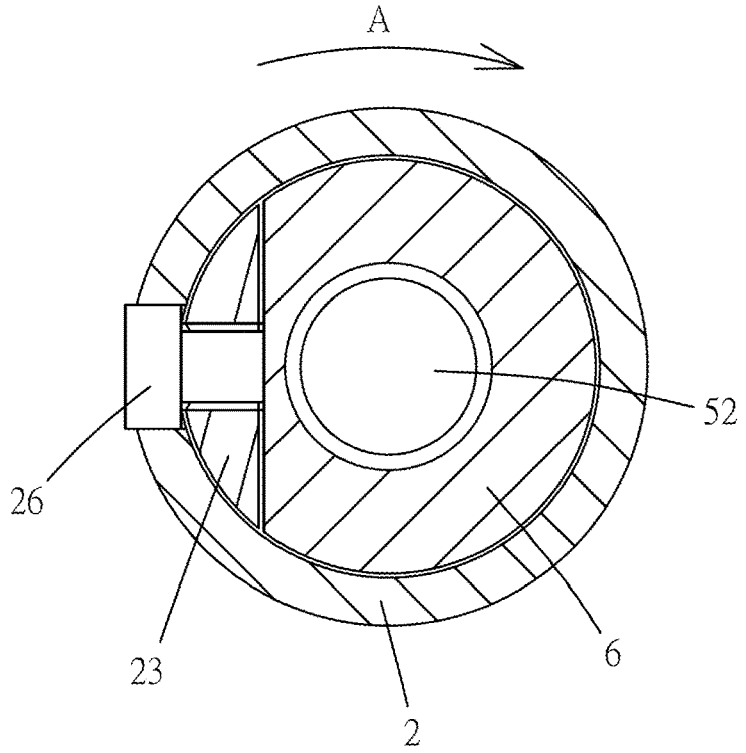
FIG. 8 is a cross-sectional view of the pushing member and the clamping member in the operating end.

Referring to FIG. 6, the feature of the present invention is that the compound operating member 5 is selectively pushed against the push rod 3 by rotating or by pressing. The push rod 3 is controlled to extend out of the acting end 22 slowly or quickly. When the push rod 3 is controlled to extend out of the acting end 22 slowly, the resistance of the flywheel 8 can be adjusted. When the push rod 3 is controlled to extend out of the acting end 22 quickly, the braking of the flywheel 8 is controlled. The shape of the pushing member 6 can be implemented in different ways according to the inner edge of the sleeve 2. Please refer to FIG. 8. In this embodiment, the inner edge of the sleeve 2 is circular. The clamping member 23 is fixed in the sleeve 2 by the fixing member 26 to block a rotation path A of the pushing member 6, so that the pushing member 6 cannot be rotated.

Figure 9:
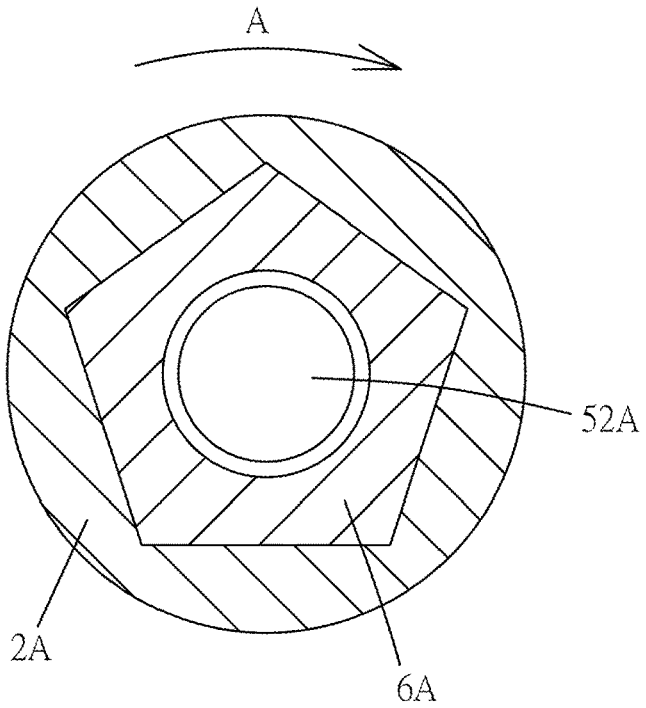
FIG. 9 is a cross-sectional view showing that the sleeve and the pushing member in the operating end have a polygonal shape.

As shown in FIG. 9, the cross-sectional profile of the inner edge of the sleeve 2A is non-circular. When the cross-sectional profile is elliptical or polygonal, the embodiment of FIG. 9 is in a pentagonal shape. The cross-sectional profile of the pushing member 6A corresponds to the cross-sectional profile of the inner edge of the sleeve 2A, and it is also in a pentagonal shape. In this way, the pushing member 6A cannot be rotated on the rotation path A and secured in the sleeve 2A.

Figure 10:
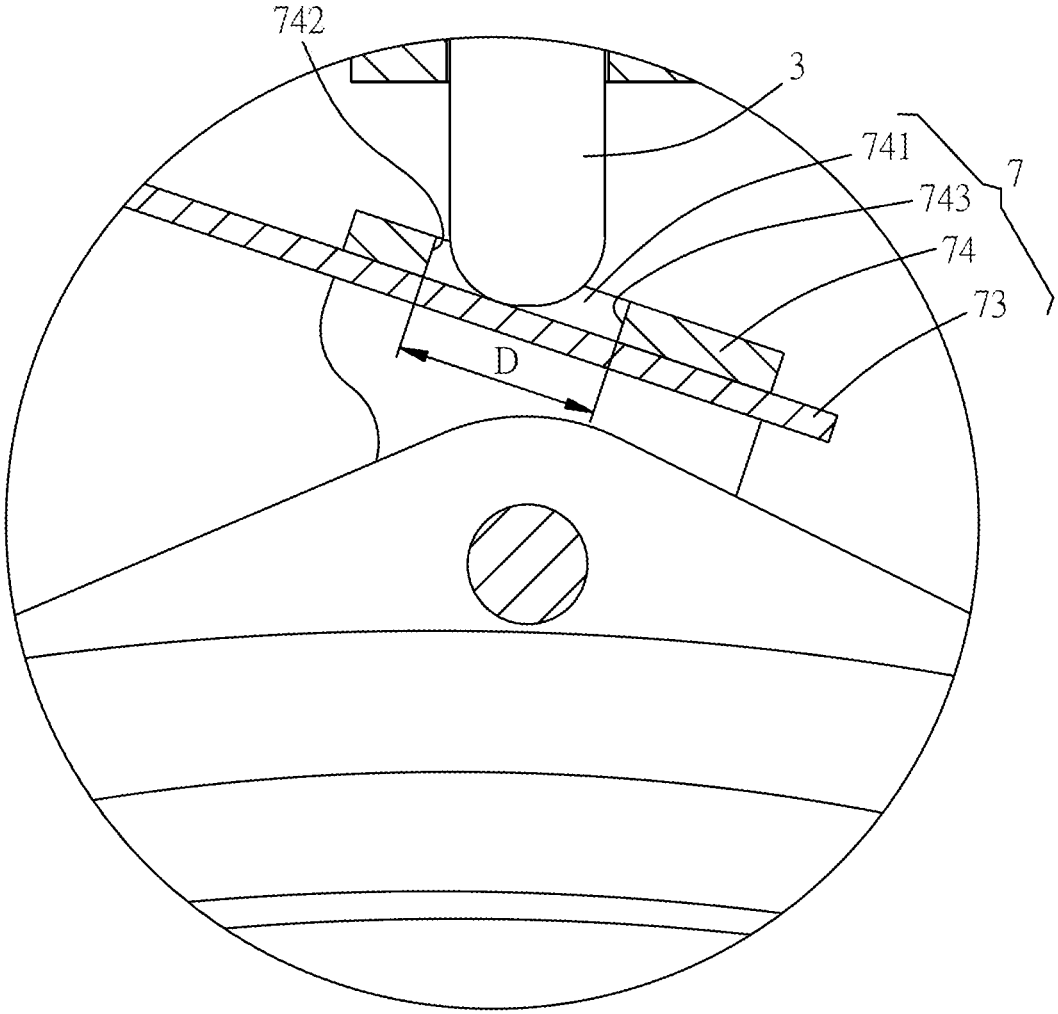
FIG. 10 is a schematic view showing that the push rod of the present invention is inserted through the notch and pressed against the elastic plate.
Figure 11:
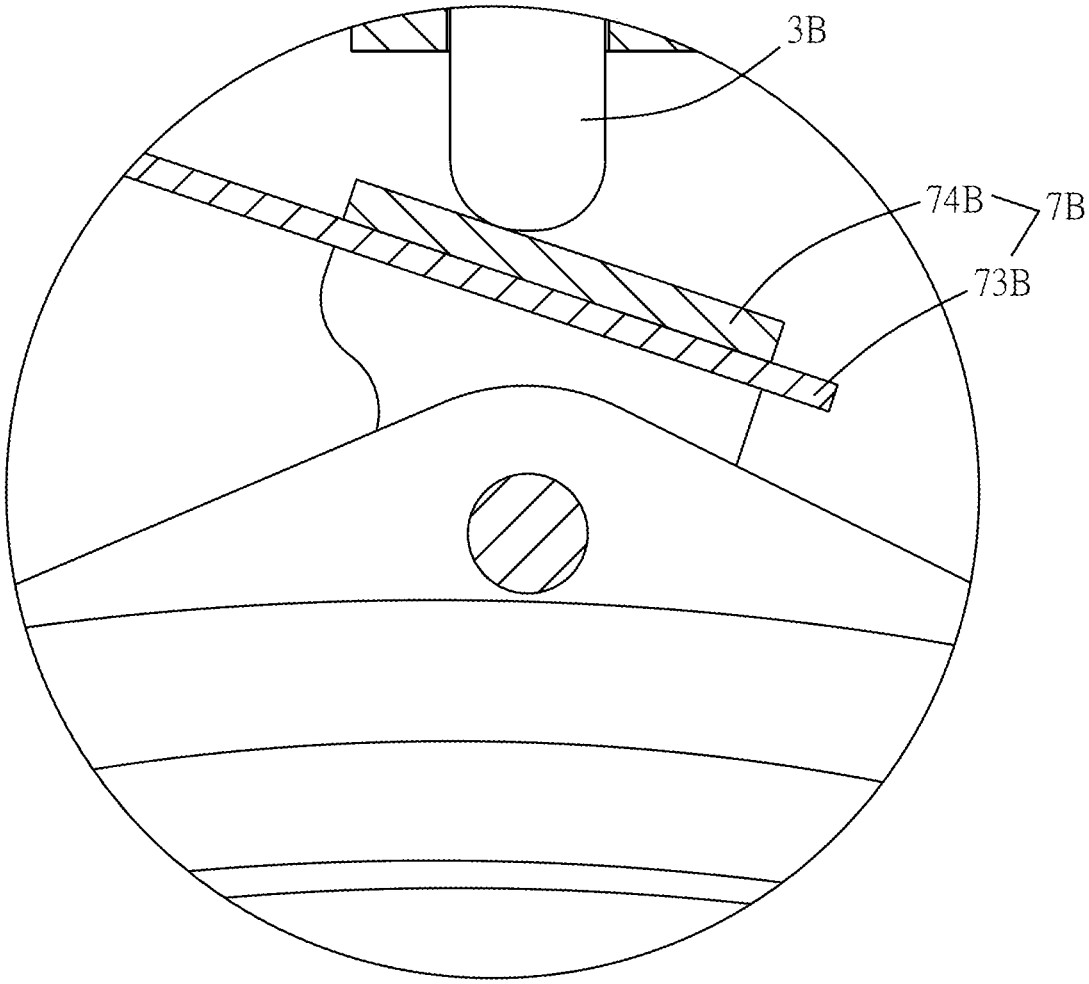
FIG. 11 is a schematic view showing that the push rod of the present invention is pressed against the pivot member.

As shown in FIG. 10, when the pivot member 74 of the resistance unit 7 has the notch 741, the push rod 3 abuts against the elastic plate 73. The push rod 3 is confined to be moved in the distance D by the first stop portion 742 and the second stop portion 743. FIG. 11 illustrates another embodiment of the resistance unit 7B. The pivot member 74B of the resistance unit 7B does not have the notch, and the push rod 3B directly abuts against the pivot member 74B.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A resistance and brake compound control structure, comprising:

a sleeve, including an operating end and an acting end;

a push rod, disposed in the sleeve, the push rod being movable to extend out of the acting end;

an elastic member, disposed in the sleeve, the elastic member being configured to exert a force to the push rod for giving the push rod a return elastic force toward the operating end;

a compound operating member, including an operating portion and a screw rod, the compound operating member being disposed at the operating end, the screw rod extending into the sleeve, the screw rod having a pushing end;

a pushing member, disposed in the sleeve in a non-rotatable manner, the pushing member having a threaded hole, the screw rod being screwed to the threaded hole; and a clamping member, fixed in the sleeve to block a rotation path of the pushing member so that the pushing member cannot be rotated, wherein when the operating portion is rotated, the pushing member stays in the sleeve through the return elastic force, the screw rod is rotated relative to the pushing member, and the pushing end is rotated to push the push rod; when the operating portion is pushed, the screw rod and the pushing member are pushed synchronously to push the push rod.

2. A The resistance and brake compound control structure as claimed in claim 1, wherein the sleeve has a circular hole, the clamping member has another threaded hole, and a fixing member is inserted through the circular hole and threadedly connected to the clamping member for fixing the clamping member in the sleeve.

3. The resistance and brake compound control structure as claimed in claim 1, further comprising a resistance unit and a flywheel, the resistance unit and the flywheel being mounted to an exercise machine, the pushing member driving the resistance unit for controlling the resistance unit to gradually contact or move away from the flywheel.

4. The resistance and brake compound control structure as claimed in claim 1, wherein one end of the push rod, facing the operating end, has a flange, the acting end of the sleeve is threadedly connected to a nut, the nut has a perforation, the push rod passes through the perforation and extends out of the acting end, the elastic member is a spring, the spring is sleeved on the push rod, and two ends of the spring abut against the flange and the nut, respectively.

5. A resistance and brake compound control structure, comprising:

a sleeve, including an operating end and an acting end, an inner edge of the sleeve has a non-circular cross-sectional profile;

a push rod, disposed in the sleeve, the push rod being movable to extend out of the acting end;

an elastic member, disposed in the sleeve, the elastic member being configured to exert a force to the push rod for giving the push rod a return elastic force toward the operating end;

a compound operating member, including an operating portion and a screw rod, the compound operating member being disposed at the operating end, the screw rod extending into the sleeve, the screw rod having a pushing end; and a pushing member, disposed in the sleeve in a non-rotatable manner and having a cross-sectional profile corresponding in shape to the cross-sectional profile of the inner edge of the sleeve, the pushing member having a threaded hole, the screw rod being screwed to the threaded hole, wherein when the operating portion is rotated, the pushing member stays in the sleeve through the return elastic force, the screw rod is rotated relative to the pushing member, and the pushing end is rotated to push the push rod; when the operating portion is pushed, the screw rod and the pushing member are pushed synchronously to push the push rod.

6. An exercise machine having a resistance and brake compound control structure, comprising:

an exercise machine body;

a resistance unit, movably mounted to the exercise machine body;

a flywheel, rotatably mounted to the exercise machine body;

a sleeve, disposed on the exercise machine body, the sleeve including an operating end and an acting end;

a push rod, disposed in the sleeve, the push rod being movable to extend out of the acting end;

an elastic member, disposed in the sleeve, the elastic member being configured to exert a force to the push rod for giving the push rod a return elastic force toward the operating end;

a compound operating member, including an operating portion and a screw rod, the compound operating member being disposed at the operating end, the screw rod extending into the sleeve, the screw rod having a pushing end;

a pushing member, disposed in the sleeve in a non-rotatable manner, the pushing member having a threaded hole, the screw rod being screwed to the threaded hole; and a clamping member, fixed in the sleeve to block a rotation path of the pushing member so that the pushing member cannot be rotated, wherein when the operating portion is rotated, the pushing member stays in the sleeve through the return elastic force, the screw rod is rotated relative to the pushing member, the pushing end is rotated to push the push rod, and the push rod abuts against the resistance unit so that the resistance unit generates a rotation resistance to the flywheel;

wherein when the operating portion is pushed, the screw rod and the pushing member are pushed synchronously to push the push rod, and the push rod abuts against the resistance unit so that the resistance unit generates a braking resistance to the flywheel.

7. The exercise machine as claimed in claim 6, wherein the sleeve has a circular hole, the clamping member has another threaded hole, and a fixing member is inserted through the circular hole and threadedly connected to the clamping member for fixing the clamping member in the sleeve.

8. The exercise machine as claimed in claim 6, wherein an inner edge of the sleeve has a non-circular cross-sectional profile, and a cross-sectional profile of the pushing member corresponds in shape to the cross-sectional profile of the inner edge of the sleeve.

9. The exercise machine as claimed in claim 6, wherein one end of the push rod, facing the operating end, has a flange, the acting end of the sleeve is threadedly connected to a nut, the nut has a perforation, the push rod passes through the perforation and extends out of the acting end, the elastic member is a spring, the spring is sleeved on the push rod, and two ends of the spring abut against the flange and the nut, respectively.

10. The exercise machine as claimed in claim 6, wherein the resistance unit has an elastic plate, a pivot member, a seat and a friction plate, the elastic plate has a fixed end and a free end, the fixed end is fixed to the exercise machine body, the pivot member is fixed to the free end, the seat is pivotally connected to the pivot member, the friction plate is secured to the seat; the push rod pushes against the fixing member or the elastic plate for the friction plate to contact the flywheel, and the elastic plate gives the seat a return force toward the sleeve.

11. The exercise machine as claimed in claim 10, wherein the pivot member has a notch, and the push rod passes through the notch and abuts against the elastic plate.

* * * * *